United States Patent [19]

Armstrong

[11] 4,360,103

[45] Nov. 23, 1982

[54] PACKAGE MEANS FOR PHOTOFLASH UNIT

[75] Inventor: Donald E. Armstrong, Williamsport, Pa.

[73] Assignee: GTE Products Corporation, Stamford, Conn.

[21] Appl. No.: 250,822

[22] Filed: Apr. 3, 1981

[51] Int. Cl.[3] ..... B65D 5/50; B65D 73/00; B65D 85/42

[52] U.S. Cl. ..... 206/482; 206/45.14; 206/419

[58] Field of Search ..... 206/418, 419, 461, 462, 206/463, 482, 489; 220/4 E

[56] References Cited

U.S. PATENT DOCUMENTS 2,043,070 6/1936 Rutkowski ..... 206/482
2,387,639 1/1943 Bouchelle ..... 206/482
3,135,384 5/1962 Cozzolino ..... 206/482
3,927,762 12/1975 Zdansky et al. ..... 206/462

*Primary Examiner*—William Price
*Assistant Examiner*—Jimmy G. Foster
*Attorney, Agent, or Firm*—Lawrence R. Fraley

[57] ABSTRACT

A packaging means for a multilamp photoflash unit ("flip-flash") having an elongated body portion and a pair of connectors extending therefrom. The packaging means comprises a single ply sheet member (e.g., paperboard) having a pair of foldable tabs spacedly located thereon. Each tab is designed for projecting from the planar sheet member to engage and surround a respective connector and thus retain the unit flush against the planar front surface of the sheet member. A fully packaged photoflash unit including the aforementioned packaging means and a multilamp photoflash unit is also described.

10 Claims, 3 Drawing Figures

PACKAGE MEANS FOR PHOTOFLASH UNIT

DESCRIPTION

1. Technical Field

This invention relates to packaging means and particularly to packaging means for photoflash units of the multilamp variety.

2. Background

Examples of multilamp photoflash units (or arrays) are described in U.S. Pat. No. 4,169,281 (Brower et al), U.S. Pat. No. 4,164,007 (Audesse et al), and U.S. Pat. No. 4,249,230 (Colville et al), all of which are assigned to the same assignee as the instant invention. In U.S. Pat. No. 4,169,281 there is shown an eight lamp unit popularly known in the industry as a "flip-flash". The eight lamps are divided into two different working groups such that those in one group are capable of being ignited when a corresponding one of the unit's two connector tabs is inserted within the socket of a suitable camera. After all lamps in this group have flashed, the unit is inverted and the second connector inserted in the camera's socket, thus electrically connecting the lamps in the unfired group. A primary function of multilamp units such as described in U.S. Pat. No. 4,169,281, in addition to the obvious function of providing instantaneous bursts of relatively high intensity light for photographic exposure, is to substantially prevent the deleterious photographic condition known as "red-eye". "Red-eye" occurs when light from the unit enters the pupils of a human subject at an established angle sufficient to illuminate the retinas in the subject's eyes, making these appear red. "Flipflash" units such as those described herein, substantially prevent this occurrence by increasing the spacing between the camera's lens and unit's flashing lamp, thus increasing the angle between the optical axis of the camera's lens and the incoming direction of light to the eyes of the subject. Accordingly, each such unit includes a pair of connectors (each for insertion within and connection to the corresponding camera's socket) which project from opposite ends (or sides) of the unit's main body portion containing the designated number of lamp's therein.

The photoflash unit described in U.S. Pat. No. 4,164,007 represents an alternate version of a "flip-flash" unit, this one including a total of ten lamps within the unit's body. Connector tabs project from upper and lower end portions of the body, as in U.S. Pat. No. 4,169,281. In the unit of U.S. Pat. No. 4,249,230, a total of six lamps, arranged in a linear manner, is provided. Connectors extend from both upper and lower end portions of the unit's longitudinal body portion.

Multilamp arrays of the above variety are preferably sold in individual units, thus requiring separate packaging of each such unit. One recognized packaging technique involves the use of a relatively large die-cut sheet that, by means of several complicated bendings thereof, results in formation of a double and/or triple thickness package defining a rectangular-shaped box or compartment into which the product is inserted. Such a technique, in addition to requiring highly complex bending procedures, also requires utilization of glues or other suitable adhesives to properly secure the mating portions. In addition, the resulting package covers various parts of the contained photoflash unit's front area, thus prohibiting full inspection of this area once the unit has been positioned within the package.

DISCLOSURE OF THE INVENTION

It is, therefore, a primary object of this invention to provide a packaging means for a multilamp photoflash unit which assures both positive containment of the unit as well as an attractive and functional means for display thereof.

It is another object of this invention to provide such a means which can be produced both inexpensively and in an expeditious manner.

It is yet another object of this invention to provide a packaging means of the type described which eliminates the need for additional materials such as glues, adhesives, etc.

It is an even further object of this invention to provide a packaged photoflash unit including the several advantageous features described herein.

In accordance with one aspect of the invention, there is provided a packaging means for a photoflash unit having a body portion and a pair of connectors which extend from opposing sides or ends of the unit's body portion. The packaging means comprises a sheet member having a substantially planar front surface and a pair of foldable tabs which form a part of or are secured to the sheet member at spaced locations thereon. Each of the foldable tabs project from the sheet member and is adapted for engaging a respective one of the connectors of the photoflash unit to retain the unit against the planar front surface.

In accordance with another aspect of the invention, there is provided a packaged photoflash unit which comprises a photoflash unit having a body portion and a pair of connectors extending from opposing sides or ends thereof, a sheet member having a substantially planar front surface, the photoflash unit being positioned on said front surface, and a pair of foldable tabs which form a part of or are secured to the sheet member at spaced locations thereon. Each of the foldable tabs project from the sheet member to engage a respective one of the connectors and thus retain the photoflash unit against the substantially planar front surface of the sheet member.

BEST MODE FOR CARRYING OUT THE INVENTION

For a better understanding of the present invention together with other and further objects, advantages and capabilities thereof, reference is made to the following disclosure and appended claims in connection with the above-described drawings.

Figure 1:
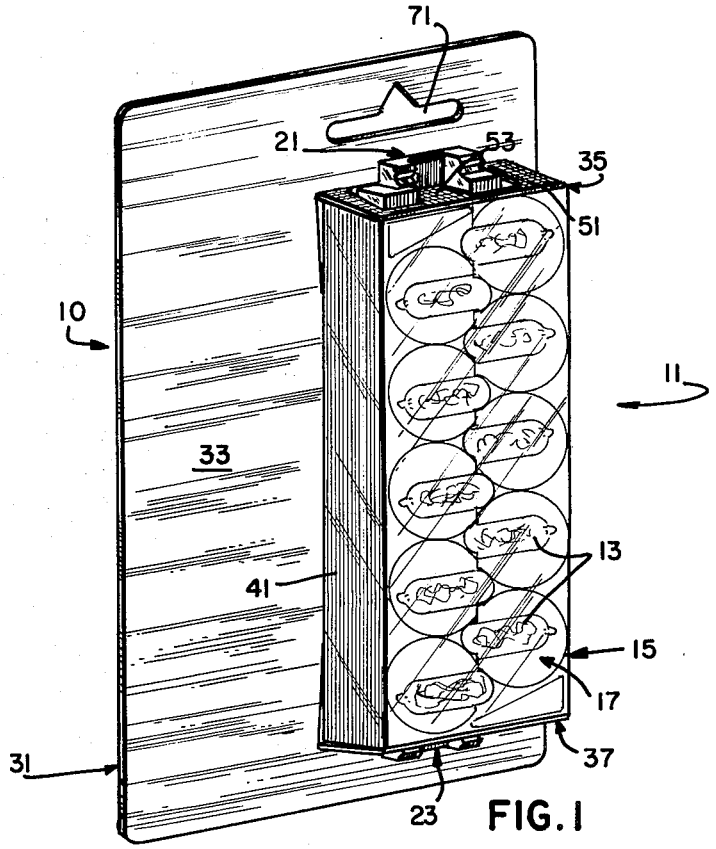
FIG. 1 is a front, perspective view of a packaging means in accordance with a preferred embodiment of the invention, said means shown retaining a multilamp photoflash unit such as described above.

With particular reference to the drawings, there is shown a packaging means 10 in accordance with a preferred embodiment of the invention. Means 10 is designed to positively secure (or contain) a multilamp photoflash unit 11 (FIG. 1) such as illustrated in the aforementioned U.S. Pat. Nos. 4,169,281, 4,164,007, and 4,249,230. The unit illustrated in FIG. 1 is similar to that described in U.S. Pat. No. 4,164,007 and includes a total of ten photoflash lamps 13 strategically located within an elongated body portion 15 of the unit. Units of this variety typically include such a body portion, said portion typically comprised of a plastic or suitable insulative material with at least the front part 17 being transparent (light-transmitting) to enable light emitted from each of the flash lamps to pass therethrough. Units of this variety also typically include a pair of opposed connectors 21 and 23 which project or extend from opposing ends (or sides) of the unit's body portion 15. As stated, each of these connectors is designed to be inserted within the corresponding socket of a suitable camera and thus connect the designated grouping of flashlamps to the power source (e.g., a piezoelectric element) typically associated with such cameras.

It is desired in the industry to merchandise photoflash units such as described above in such a manner that each unit is separately packaged and thus available for inspection by a prospective purchaser. As will be understood from the following, the instant invention not only provides these important and advantageous features, but also does so in both a facile and inexpensive manner. As will be described, positive containment or securement of photoflash units of the variety described is accomplished by the invention without the need for additional materials such as blister packs, glues, adhesives, etc., as well as relatively complex and expensive folding or bending procedures typically required in multithickness package displays.

To provide the above, packaging means 10 comprises simply a sheet member 31 having a substantially planar front surface 33 against which the substantially planar back surface of the body portion 15 of unit 11 is retained.

Retention of unit 11 is achieved by a pair of substantially similar foldable tabs 35 and 37 which are spacedly located on sheet 31 and designed for projecting outwardly therefrom to engage a respective one of the connectors 21 and 23 of unit 11 and thus retain the entire unit against surface 33. Each tab 33 and 37 preferably is formed from the original sheet member (see FIG. 2) or may constitute a separate component secured to the planar surface 33 at the locations shown. As particularly illustrated in FIG. 1, this securement is accomplished such that the front part of unit 11 remains uncovered (exposed) to thus enable a prospective purchaser to view the entire contents thereof. It can also be seen that such a person may also view the longitudinal sides 41 of the unit, if desired.

Figure 2:
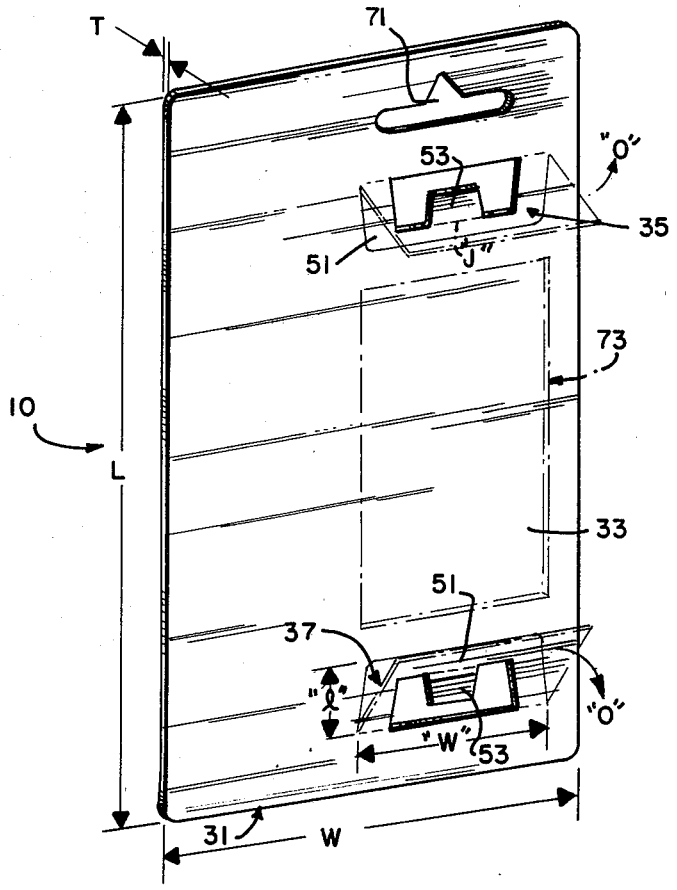
FIG. 2 is a front perspective view of the packaging means of FIG. 1 without a photoflash unit.

With particular reference to FIG. 2, each of the foldable tabs 35 and 37 is illustrated as comprising an integral part of the sheet member 31 and designed for being folded outwardly therefrom ("o") to the extent necessary to encompass and secure the connectors 21 and 23. With combined reference to FIGS. 2 and 3, it can be seen that when each tab (only one shown in FIG. 3) its outwardly displaced to its full engaging position, an aperture 43 is defined within the planar sheet member 31. Accordingly, when each tab constitutes part of a sheet member as illustrated it is possible for prospective purchaser to also view preselected portions of the rear area of unit 11.

Each foldable tab 35 and 37 includes a substantially planar main segment 51 which during retention of unit 11 is designed to rest against one of the opposing ends (or sides) 36 of the unit's body portion from which the corresponding connector projects. Accordingly, the planar segment 51 forms a predetermined angle ("a") with the planar front surface 33. This angle is preferably within the range of from about 70 to about 90 degrees, thus substantially corresponding to the angle of taper of said end or side.

Figure 3:
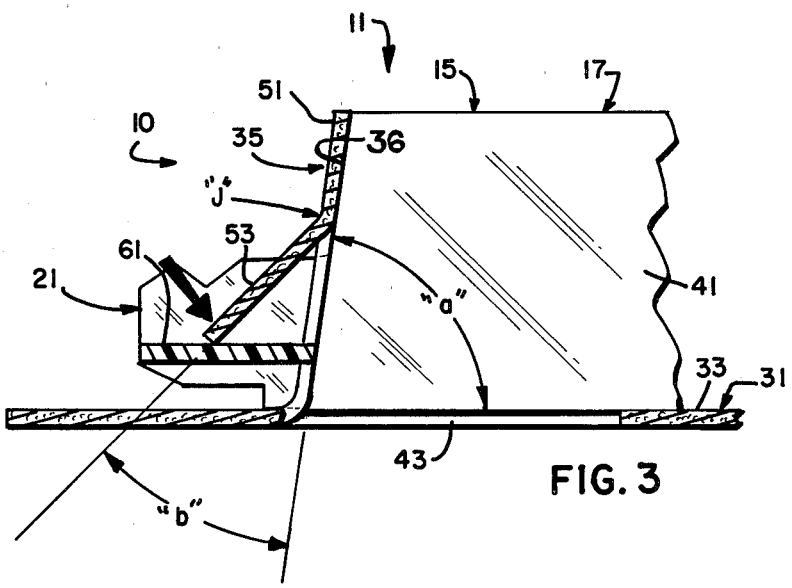
FIG. 3 is a partial, side elevational view, partly in section, illustrating one of the two foldable tabs of the invention and how this tab engages a respective connector of the aforementioned photoflash unit.

Each foldable tab further includes a tongue segment 53 substantially centrally located on main segment 51 and projecting therefrom. Tongue 53 positively engages a corresponding surface 61 of the respective connector (FIG. 3) to thus exert a downward force thereon (see arrow in FIG. 3) and assure that body portion 15 lies flush against the planar surface 33. As shown in FIG. 3, the connector 21 is substantially offset with respect to the front surface 17 of unit 11 such that it lies closer to the back surface of this unit. It is understood with regard to the invention, however, that packaging means 10 is readily capable of positively retaining photoflash units having the projecting connectors oriented in different fashion (e.g., centrally disposed, or more toward the front of the unit). Retention could be readily achieved in such instances by merely reducing the length of the engaging tongue 53 or repositioning it at a new location. It is thus seen that the invention is extremely versatile and readily able to positively retain photoflash units having body portions and connectors of varying dimensions and arrangement. In the final securing position, each tongue 53 preferably forms an angle ("b") of from about 5 to about 25 degrees with that of the planar main segment 51. As understood, each tongue 53, is bendable (or foldable) at the location of jointure ("j") with main segment 51. It is further understood that varying shapes for tongue 53 other than the planar, rectangular configuration illustrated, can be successfully utilized. The shape described and illustrated is preferred in view of the existing structural configuration for of connectors 21 and 23. More particularly, these connectors typically include a channel or slot therein having an extention of the unit's planar circuit board strategically positioned and retained with the slot. In this regard, it is preferred that tongue 53 be designed to be inserted within this slot or channel and engage the forward surface (61) of the unit's circuit board in the manner illustrated.

As shown in FIGS. 1 and 2, sheet member 31 is of a width in excess of that of the corresponding photoflash unit 11. This is preferred to enable positioning of trademark and various advertising information thereon, thus adding to the attractiveness of the assembled package. In addition, sheet member 31 further includes an elongated slot 71 near the upper end portion thereof to permit hanging of the packaged unit on a suitable display hook prior to sale.

As an alternate embodiment, it is also within the scope of the invention to provide a substantially transparent section 73, shown in phantom in FIG. 2, within the sheet 31 at the portion of the sheet where the back portion of unit 10 finally rests. This added feature will thus assure that inspection of almost the entirety of the rear of unit 11 can be achieved without disassembling the packaged unit.

Sheet member 31, as well as tabs 35 and 37, is preferably of paperboard material having a single ply thickness within the range of from about 0.015 inch to about 0.025 inch. In one example, sheet 31 had a thickness (T) of 0.020 inch. In said example, the sheet also had a width (W) of approximately 3.75 inches, and a length (L) of about 6.625 inches. Each tab 35 and 37 possessed an overall width ("w") of approximately 1.75 inches, and a length ("l") of approximately 0.563 inch. In addition, tabs 35 and 37 in this example were spaced apart a distance (from location of fold on sheet 31) of about 5.0 inches.

Positioning of unit 10 on sheet 31 is accomplished simply by outwardly displacing each of the foldable tabs 35 and 37 to a position sufficient to enable locating of the unit against the planar surface 33 therebetween. Each tab is then simply folded over the respective connectors of the unit such that the respective tongue segments 53 are located within the corresponding slot or channel defined by each connector. Assembly is thus accomplished in a facile manner, and can be readily achieved manually or by a relatively simple mechanical procedure. The invention thus lends itself to mass production and the cost advantages associated therewith. Use of single ply material also understandably represents a substantial cost savings over other packaging schemes utilizing the aforementioned additional materials and procedures.

It is understood with regard to the invention that the downward exertion of the springlike or biasing force by the foldable tongue 53 against the respective planar surface of the connector being engaged in turn causes the tab's planar main segment to also exert a force against the end surface 36 of the unit's body portion. Accordingly, both tabs 35 and 37 work in a cooperative manner to positively retain unit 11 in the manner indicated. More specifically, this unique arrangement serves to hold the unit in compression while on sheet 31 and thus substantially prevent lateral movement of the unit during handling, shipping, etc. In addition, the substantially downward force exerted by each tongue 53 also prevents any forward movement (away from planar surface 33) of unit 11.

There had thus been shown and described a new and unique means for packaging a photoflash unit of the multilamp variety, said means assuring positive securement of the unit and enabling full inspection of the front portion thereof by a prospective customer. It is also understood that this packaging arrangement permits inspection of a major portion of the unit by the manufacturer prior to shipment thereof for sale. This added feature also serves to reduce manufacturing costs by substantially reducing the possibility of customer return in the event of a defective product. The invention as described also possesses several cost advantages for the reasons stated above.

There has also been shown and described a packaged photoflash unit, including the aforementioned unique packaging means and photoflash unit contained therein. Such a packaged unit can be quickly assembled at relatively low cost and in its final form presents both a functional (to enable inspection thereof) and attractive (for purposes of sale) assembly.

While there have been shown and described what are at present considered the preferred embodiments of the invention, it will be obvious to those skilled in the art that various changes and modifications may be made therein without departing from the scope of the invention as defined by the appended claims.

What is claimed is:

1. Packaging means for a photoflash unit having a body portion and a pair of connectors extending form opposing ends of said body portion, said packaging means comprising:

a sheet member having a substantially planar front surface; and a pair of foldable tabs forming a part of or secured to said sheet member at spaced locations thereon, each of said foldable tabs adapted for projecting from said sheet member to engage a respective one of said connectors of said photoflash unit and retain said unit against said substantially planar front surface of said sheet member, the front part of said body portion of said photoflash unit being uncovered to enable inspection thereof, each of said foldable tabs including a substantially planar main segment for engaging a respective one of said ends of said body portion of said photoflash unit from which said connector extends during said retention and a tongue segment projecting from said main segment for engaging said connector to provide said retention against said sheet member.

2. The packaging means according to claim 1 wherein said main segment of each of said foldable tabs forms an angle with said substantially planar front surface of said sheet member within the range of from about 70 to about 90 degrees during said retention of said photoflash unit.

3. The packaging means according to claim 1 wherein said tongue segment exerts a springlike force against said connector, said exertion of said springlike force providing said retention of said photoflash unit against said planar surface of said sheet member and causing said main segment of said tab to engage said end of said body portion of said photoflash unit.

4. The packaging means according to claim 3 wherein said tongue segment is bendable at the location of jointure with said main segment, said tongue segment forming an angle with said planar main segment during said engagement with said connector.

5. The packaging means according to claim 4 wherein said angle formed between said tongue segment and said main segment is within the range of about 5 to about 25 degrees.

6. The packaging means according to claim 1 wherein the material for said sheet member and each of said foldale tabs is paperboard.

7. The packaging means according to claim 6 wherein said paperboard is of single ply thickness.

8. The packaging means according to claim 1 wherein the portion of said sheet member having said photoflash unit positioned thereagainst by said foldable tabs is substantially transparent to enable inspection of the part of said photoflash unit against said sheet member from the rear of said member.

9. The packaging means according to claim 1 further including an aperture within said sheet member adjacent each of said foldable tabs during projection of said tabs from said sheet member and retention of said photoflash unit to enable inspection of preselected portions of said photoflash unit from the rear of said sheet member during said retention thereof.

10. A packaged photoflash unit comprising:

a photoflash unit including a body portion and a pair of connectors extending from opposing ends of said body portion;

a sheet member having a substantially planar front surface, said photoflash unit positioned on said front surface; and a pair of foldable tabs forming a part of or secured to said sheet member at spaced locations thereon, each of said foldable tabs projecting from said sheet member and engaging a respective one of said connectors of said photoflash unit to retain said unit against said substantially planar front surface of said sheet member, the front part of said body portion of said photoflash unit being uncovered to enable inspection thereof, each of said foldable tabs including a substantially planar main segment for engaging a respective one of said ends of said body portion of said photoflash unit from which said connector extends during said retention and a tongue segment projecting from said main segment for engaging said connector to provide said retention against said sheet member.

* * * * *